US007465116B2

(12) United States Patent
Sorrell

(10) Patent No.: US 7,465,116 B2
(45) **Date of Patent: *Dec. 16, 2008**

(54) HAND-HELD BODY WASHING DEVICE

(76) Inventor: Roger Sorrell, 9804 Southview Ct., Raleigh, NC (US) 27603

( * ) Notice: Subject to any disclaimer, the term of this patent is extended or adjusted under 35 U.S.C. 154(b) by 0 days.

This patent is subject to a terminal disclaimer.

(21) Appl. No.: 11/676,575

(22) Filed: Feb. 20, 2007

(65) Prior Publication Data

US 2007/0147949 A1 Jun. 28, 2007

Related U.S. Application Data

(60) Continuation of application No. 10/984,616, filed on Nov. 9, 2004, now Pat. No. 7,182,540, which is a continuation-in-part of application No. 10/165,149, filed on Jun. 7, 2002, now Pat. No. 6,887,007, which is a continuation-in-part of application No. 10/074,164, filed on Feb. 12, 2002, now abandoned, which is a division of application No. 09/800,950, filed on Mar. 7, 2001, now Pat. No. 6,368,003.

(51) Int. Cl.
*B43M 11/06* (2006.01)

(52) U.S. Cl. ..... 401/205; 401/183

(58) Field of Classification Search ..... 401/183–186, 401/196–207

See application file for complete search history.

(56) References Cited

U.S. PATENT DOCUMENTS 5,727,277 A * 3/1998 Chien ..... 15/209.1
6,161,246 A * 12/2000 Trachtenberg ..... 15/229.13
6,413,000 B1 * 7/2002 Borcherds et al. ..... 401/118
6,536,977 B1 * 3/2003 Hammel ..... 401/205

* cited by examiner

*Primary Examiner*—David J Walczak
(74) *Attorney, Agent, or Firm*—Coats & Bennett, P.L.L.C.

(57) ABSTRACT

A hand-held washing device comprises a pouf and a fluid dispenser secured to the pouf. The fluid dispenser comprises a fluid reservoir and a nozzle with a discharge outlet. The nozzle may be integrally formed with the fluid reservoir, or may be a separate component that is removable.

3 Claims, 11 Drawing Sheets

HAND-HELD BODY WASHING DEVICE

RELATED APPLICATIONS

The present application is a continuation of application Ser. No. 10/984,616, filed Nov. 9, 2004, now U.S. Pat. No. 7,182,540, which is a continuation-in-part of U.S. patent application Ser. No. 10/165,149 filed Jun. 7, 2002, now issued as U.S. Pat. No. 6,887,007, which is a continuation-in-part of U.S. patent application Ser. No. 10/074,164 filed Feb. 12, 2002, now abandoned, which is a divisional of U.S. patent application Ser. No. 09/800,950 filed Mar. 7, 2001, now issued as U.S. Pat. No. 6,368,003, which are hereby incorporated by reference in their entirety.

BACKGROUND OF THE INVENTION

The present invention is directed to a hand-held washing device and, more particularly, a washing device comprising a pouf and a fluid dispenser containing liquid soap or the like.

A variety of hand-held washing devices are available such as scrub brushes, sponges, and the like. These require that soap be separately applied prior to using the device. After the soap is applied, the device is used for scrubbing or otherwise distributing the soap along a user's body. This is inconvenient as it either requires the user to hold the soap in one hand and the washing device in the other, or requires the user to repeatedly pick up and set down the device and soap as needed.

SUMMARY OF THE INVENTION

The present invention relates to a washing device comprising a pouf and a fluid dispenser or figurative handle disposed within and at least partially surrounded by the pouf. The fluid dispenser comprises a fluid reservoir and a nozzle with a discharge outlet. The nozzle may be integrally formed with the fluid reservoir, or may be a separate component that is removable. In one embodiment of the invention, the reservoir includes a fill opening sealed with a removable plug for refilling the fluid reservoir. In another embodiment, the nozzle inserts into the fill opening in the reservoir and is removed to refill the fluid reservoir. The pouf may be made of any suitable material, such as a nylon mesh, or fabric or sponge material. In one embodiment, the pouf is made of a sheet material that is gathered to form a pleated ball.

In one aspect of the invention, a cinch extends around the pouf and fluid dispenser or figurative handle to secure the pouf to the fluid dispenser or figurative handle.

In another aspect of the invention, the pouf has a central opening therein and the fluid dispenser or figurative handle is secured within the central opening of the pouf.

DETAILED DESCRIPTION OF THE INVENTION

Figure 1:
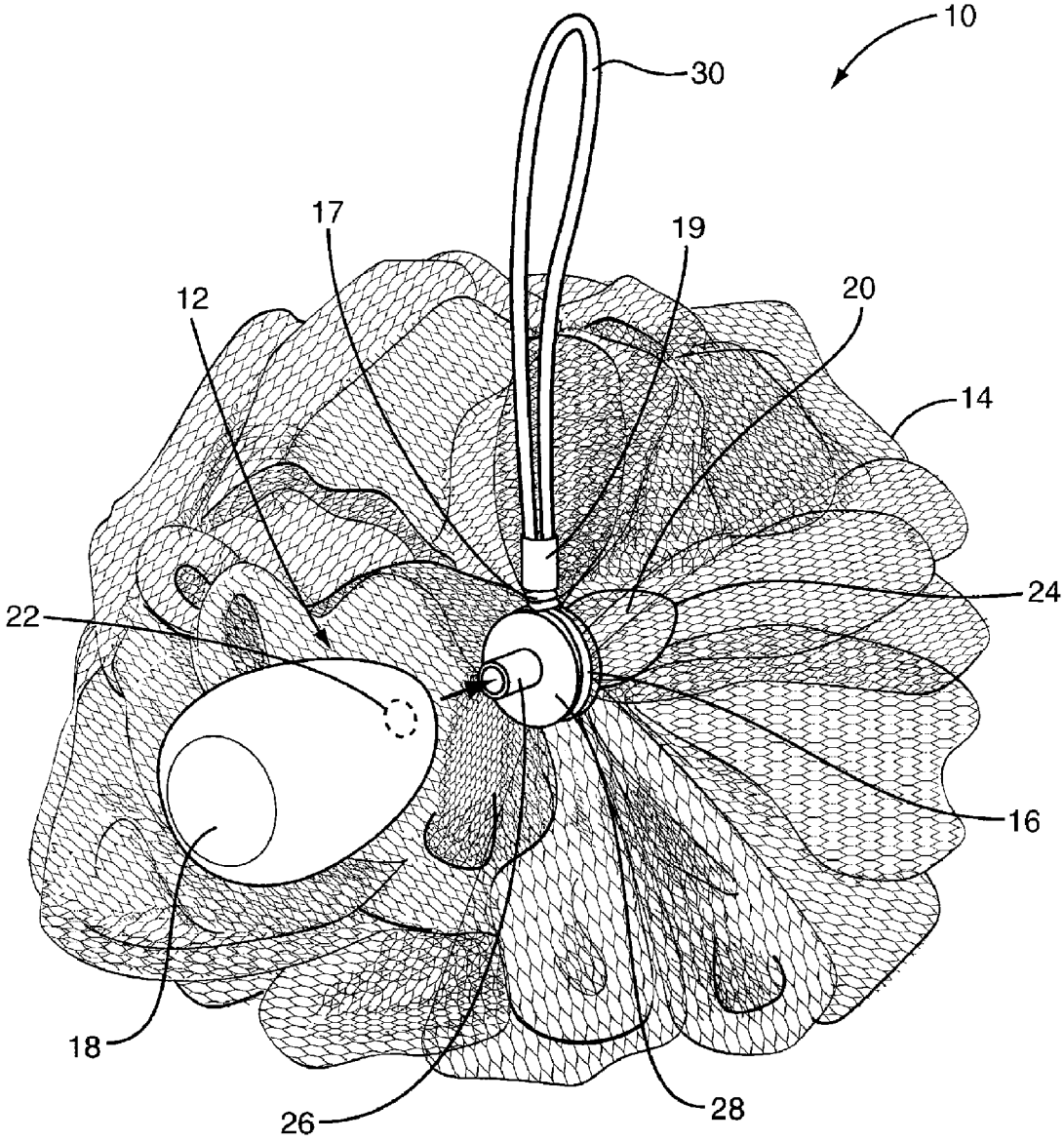
FIG. 1 is a perspective view illustrating a first embodiment of the washing device comprising a fluid dispenser with removable nozzle and a pouf.

The present invention is a hand-held washing device, illustrated generally by the numeral 10. The washing device 10 comprises a fluid dispenser 12, a pouf 14, and a cinch 16 for securing the pouf 14 to the fluid dispenser 12. In the embodiment shown in FIG. 1, the fluid dispenser 12 comprises a fluid reservoir 18 and a removable nozzle 20. The fluid dispenser 12 includes a fill opening 22 into which the nozzle 20 is inserted. The nozzle 20 includes a discharge outlet 24 through which the fluid is emitted and a neck 26 that fits snugly within the fill opening 22 of the fluid reservoir 18 to prevent leakage. Neck 26 may be flared on the end to help retain the nozzle 20 in the fill opening 22 and to provide a secure seal. The neck 26 could also be externally threaded and screw into a threaded fill opening 22 in the fluid reservoir 18. In one embodiment, fluid reservoir 18 is a flexible bulb that is squeezed to force the liquid out through the discharge outlet 24. When the liquid is depleted, the user separates the nozzle 20 from the fluid reservoir 18, refills the fluid reservoir 18 with fluid, and then reattaches the nozzle 20 to the fluid reservoir 18

The pouf 14 is preferably constructed from a mesh sheet. Mesh provides some abrasive characteristics when the user scrubs with the device 10 to aid in the washing process. Mesh may also dry quicker than a woven or knit material to prevent bacteria from forming within the material between uses. Additionally, mesh allows air to move through the device to quickly dry the washing device 10. The mesh may further be non-absorbent. In one embodiment, the mesh is constructed of nylon, but other natural or synthetic materials may be used. The pouf 14 is formed by gathering and tying the mesh sheet to form a pleated ball.

A cinch 16 binds the mesh sheet into a pleated ball to form the pout 14, and secures the pouf 14 to the fluid dispenser 12. In one embodiment, cinch 16 comprises a string that extends around the fluid dispenser 12 and is tied to secure the pouf 14 to the nozzle 20. The string forming the cinch 16 may include a loop 30 that can be used to hang or suspend the washing device 10. The string may be tied to from a knot 17. Alternatively, or in addition thereto, a locking member 19 may slide over the sting and up against the nozzle 20 to cinch the string. In another embodiment, cinch 16 may comprise an elastic band that is stretched to extend around the pouf 14 and fluid dispenser 12. The cinch 16 may also comprise a metal band. The pleats in the pouf 14 substantially conceal the cinch 16 and nozzle 20 so that cinch 16 and nozzle 46 do not directly contact the user when bathing with the device 10.

Those skilled in the art will appreciate that gathering and tying the mesh sheet creates a central opening 15 in the pouf 14. The washing device 10 can be made by first forming the pout 14 and then inserting the fluid dispenser 12 into the central opening 15 in the pouf 14 as shown in FIG. 2. In the embodiment shown in FIGS. 1 and 2, the nozzle 20 is disposed on one side of the central opening 15 in the pouf 14 and the neck 26 passes though the central opening 15. The fluid reservoir 18 is disposed on the opposite side of the central opening 15 in the pouf 14. Nozzle 20 may further include flanges 28 for retaining the cinch 16. Flanges 28 are spaced slightly apart to form a channel to receive the cinch 16. The flanges 28 may be an integral part of the nozzle 20, or may be discrete washer-like components, such as snap rings, that slide over the neck 26.

Figure 3:
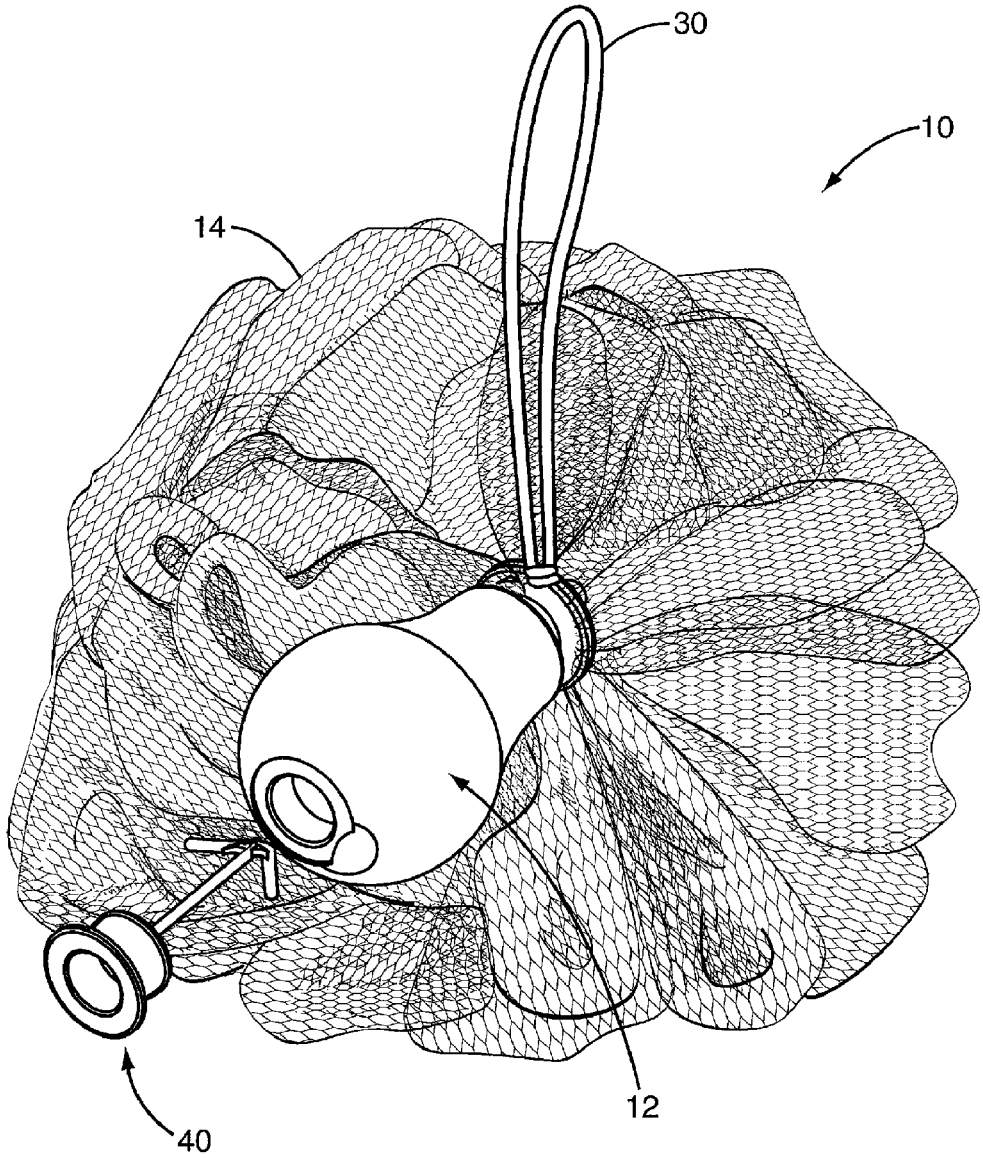
FIG. 3 is perspective view of a second embodiment having a one-piece fluid dispenser.
Figure 4:
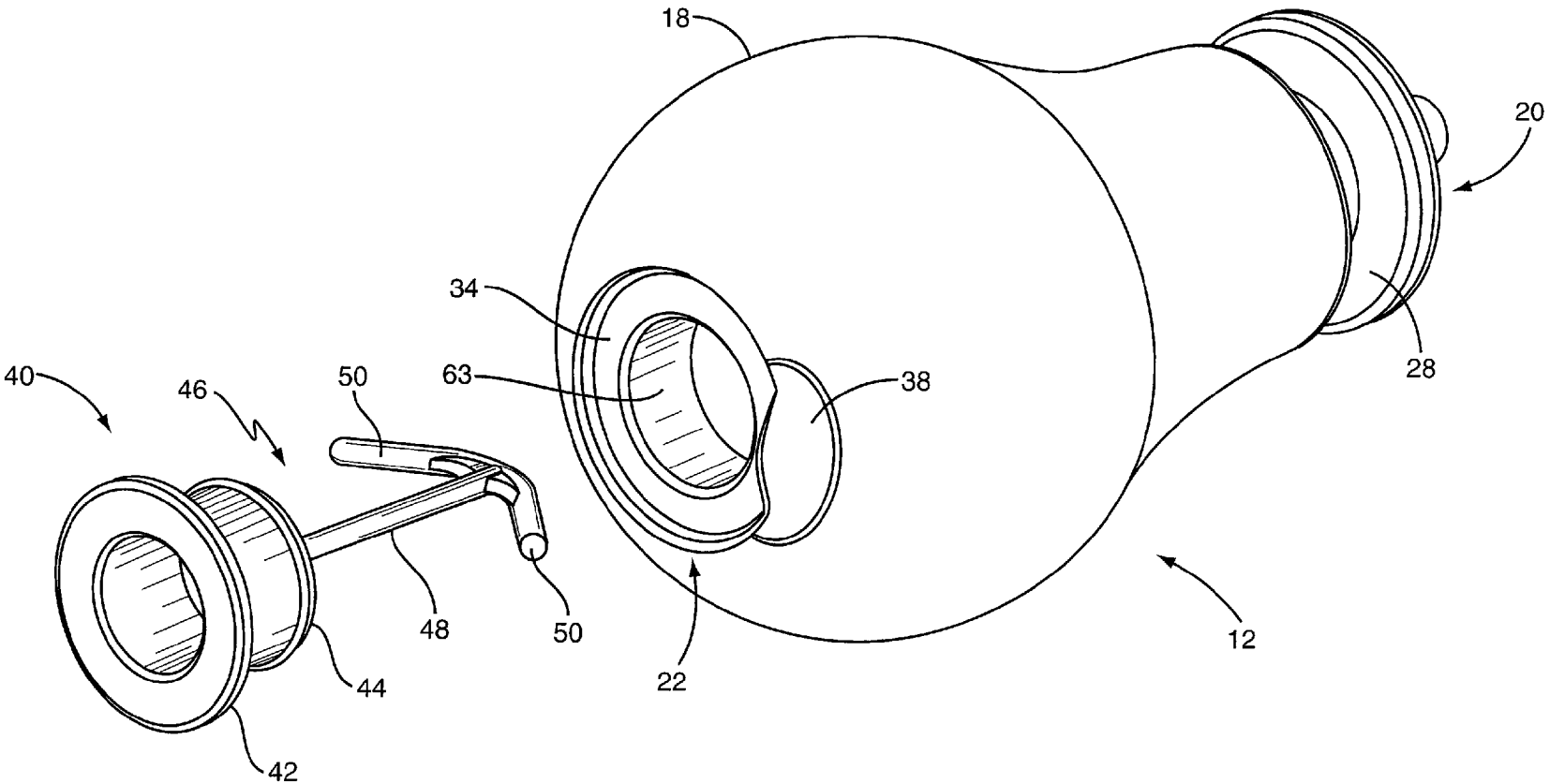
FIG. 4 is a perspective view of a one-piece fluid dispenser as seen from the back.
Figure 5:
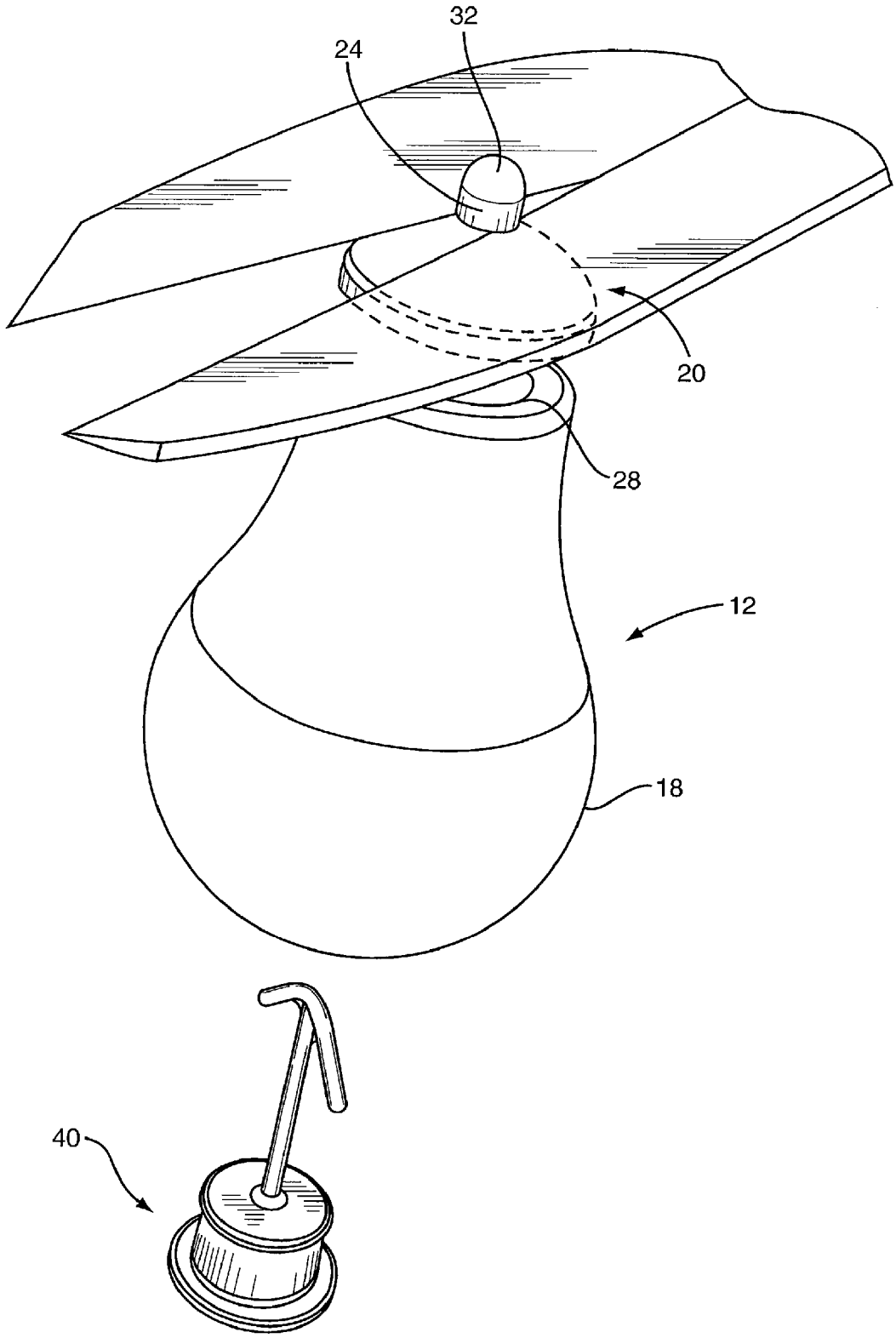
FIG. 5 is a perspective view of the one-piece fluid dispenser as seen from the front.

FIGS. 3-5 illustrate a second embodiment of a washing device 10. The second embodiment is similar to the first so the same reference numbers are used to indicate similar elements. The fluid dispenser 12 comprises an integral fluid reservoir 18 and nozzle 20. The nozzle 20 and fluid reservoir 18 may be made of a different material. For example, the fluid reservoir 18 may be rubber while the nozzle 20 may be plastic. The fluid dispenser 12 includes an integrally formed channel adjacent nozzle 20. The nozzle 20 includes a nipple 30, which serves as a discharge outlet 24 when the tip of the nipple 30 is cut as shown in FIG. 5. Fluid is discharged from the fluid dispenser 12 by squeezing the fluid reservoir 18, thereby forcing fluid out through the discharge outlet 24. The fluid dispenser 12 could include a discharge assistant, such as a manual pump, to discharge fluid out through the discharge outlet 24.

The fluid reservoir 18 in the second embodiment includes a fill opening 22 with a removable plug 40. Plug 40 is sized to fit within the fill opening 22 to contain the fluid within the fluid reservoir 18 without leaking. Plug 40 can be removed from the fill opening 22 to fill the fluid dispenser 12. Fill opening 22 can have a variety of shapes and sizes and can be located at a variety of positions on the fluid reservoir 18. In one embodiment, fill opening 22 is positioned on the rear of the fluid reservoir 18 opposite the nozzle 20.

The fill opening 22 may be recessed to from a seat 34. The recessed seat 34 extends around at least a portion of the fill opening 60. Recessed seat 34 has a depth and size to mate with an upper seal 42 of the plug 40 to contain liquid within the fluid dispenser 12. The seat 34 is recessed such that the plug 40 is flush with the surface of the fluid dispenser 12 when inserted within the fill opening 22. The fluid dispenser 12 may have a slight depression 38 adjacent the fill opening 22 that allows a user to more easily remove the plug 40. More particularly, the depression allows the user to grasp the edge of the upper seal 42 of the plug 40 and remove the plug 40 from the fill opening 22.

Plug 40 may have a variety of shapes and sizes, depending upon the size and shape of the fill opening 22. In the embodiment illustrated in FIG. 6, plug 40 includes an upper seal 42 and an inner seal 44. The upper seal 42 comprises a flange that engages the recessed seat 34. The inner seal 44 engages the inner wall 36 of the fill opening 22. The plug 40 may further include an retainer 46 to loosely connect the plug 40 to the fluid dispenser 12. In one embodiment, retainer 46 includes an elongated stem 48 integrally formed with the body of the plug 40 and a pair of laterally projecting arms 50 projecting outwardly from the end of the stem 48. The span of the arms 50 is greater than the diameter of the fill opening 22 so that the arms 50 prevent the plug 40 from being separated from the fluid dispenser 12 when it is removed to refill the fluid dispenser 12. The stem 48 is long enough such that the plug 40 does not interfere with the fill opening 22 during filling.

Figure 6:
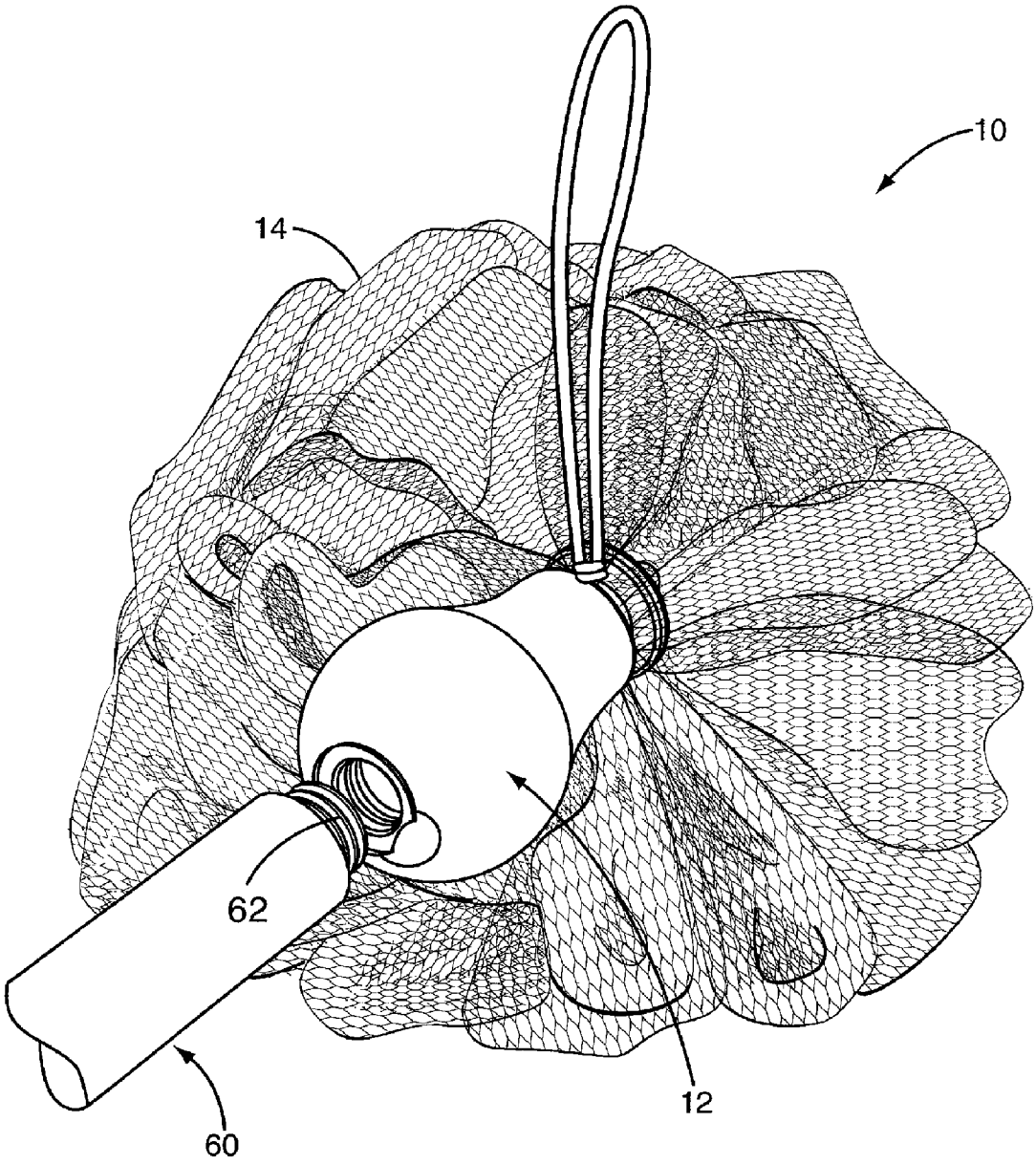
FIG. 6 is a perspective view of a third embodiment of the present invention.

FIG. 6 illustrates another embodiment in which the fill opening 22 of the fluid dispenser 12 is internally threaded for attaching to a threaded end 62 of a shaft 60. The shaft 60 may have a variety of lengths, and enables the user to access parts of the body with the washing device 10 that may not be reached by hand. In one example, shaft 60 is of a length such that the user can wash their back.

Figure 2:
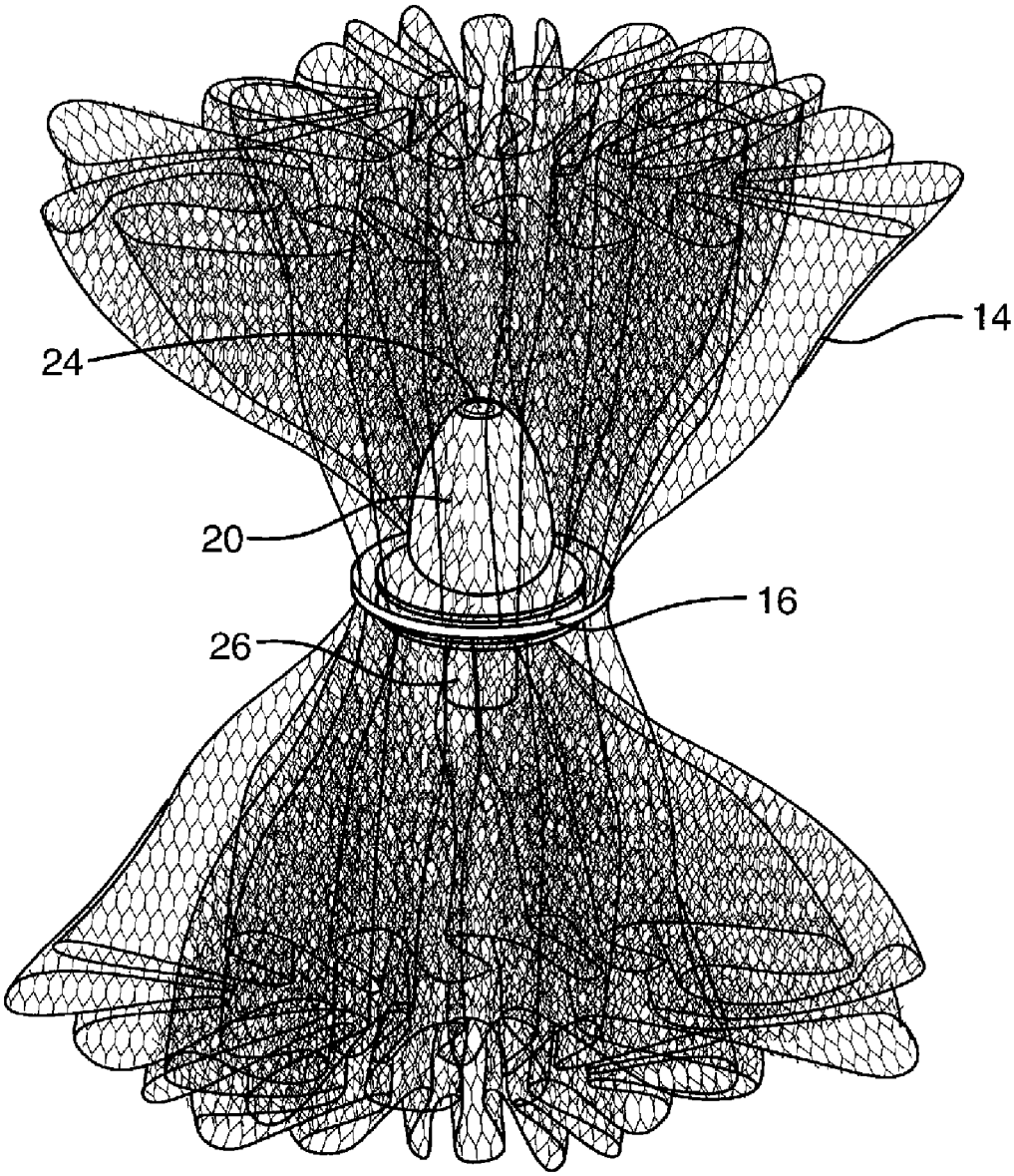
FIG. 2 is a perspective view illustrating the nozzle being inserted into a central opening of the pouf and secured by a cinch.
Figure 7:
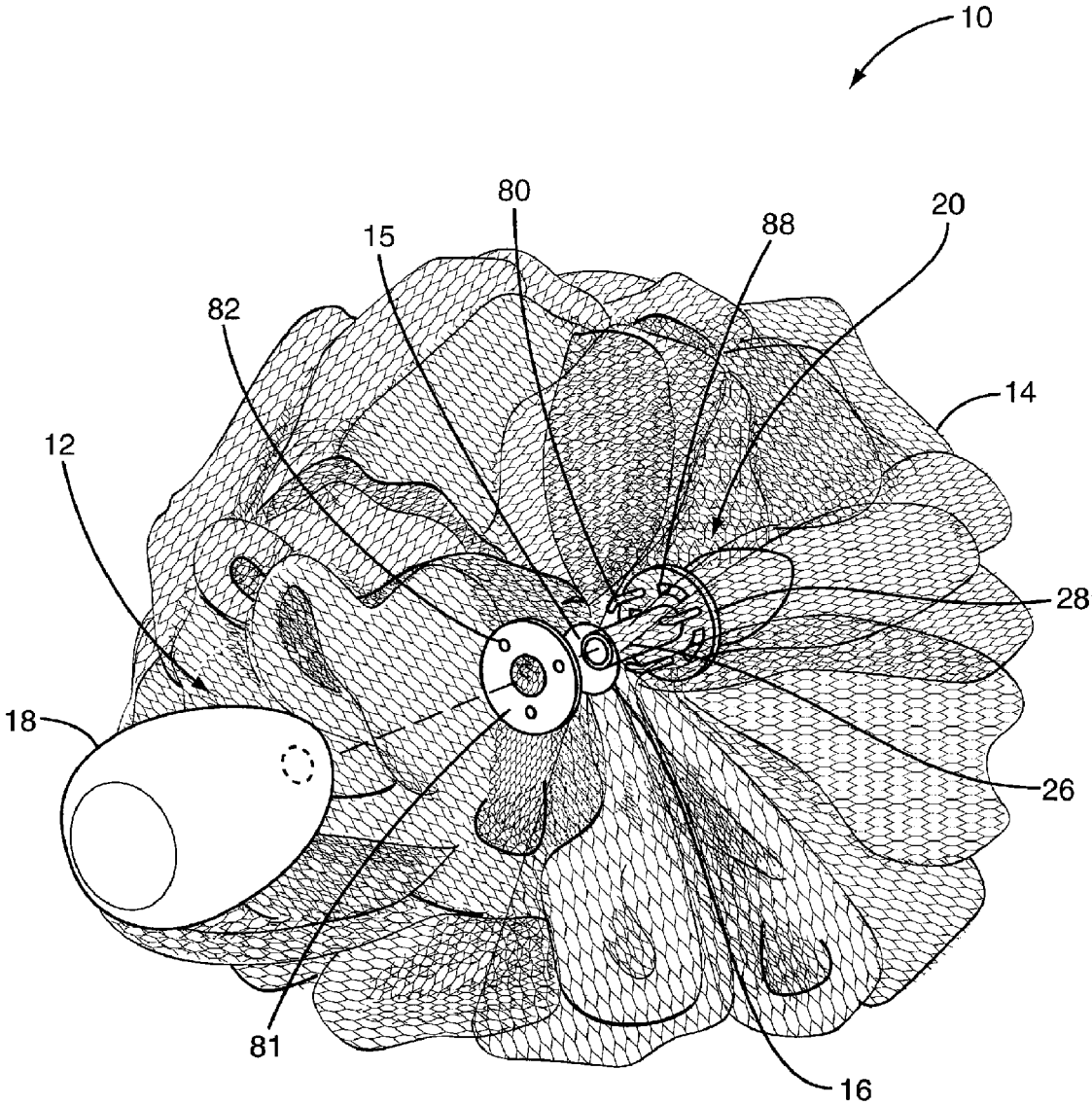
FIG. 7 is a perspective view of a fourth embodiment of the present invention.
Figure 11:
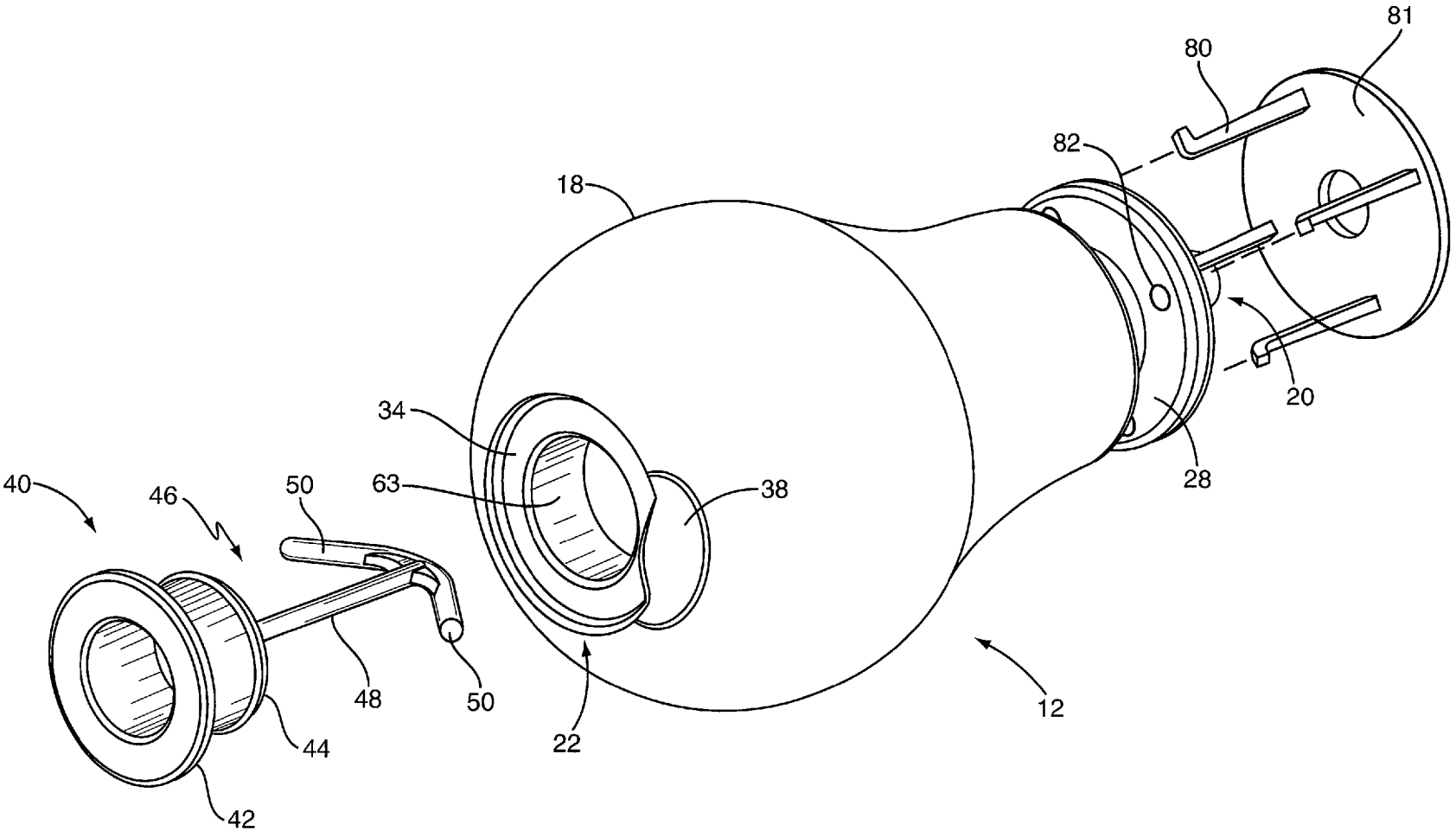
FIG. 11 is a perspective view of an alternate embodiment of the present invention.

FIG. 7 illustrates another embodiment of the present invention similar to the embodiment shown in FIG. 1. The embodiment shown in FIG. 7 comprises a fluid dispenser 12 with a removable fluid reservoir 18 and nozzle 20. The nozzle 20 includes a neck 26 as previously described that extends through a central opening 15 in the pouf 14. The nozzle 20 includes an integral flange 28 with protecting fingers 80. The fingers 80 pass through the mesh pouf and engage openings 82 in a securing member 81. An adhesive 88 may be applied to the flange 28 to aid in securing the pouf 14 to the nozzle 20. When the mesh is compressed between the securing member 81 and the flange 28, the adhesive 88 will flow through the interstices of the mesh to form a secure bond between the pouf 14 and nozzle 20. While FIG. 7 illustrates the fingers 80 extending from the flange 28, those skilled in the art will appreciate that the fingers 80 may be formed on the securing member 81 and that the openings 82 may be formed in flange 28. Further, it will be appreciated that the securing member 81 may be integrally formed with the fluid reservoir 18. Also, the nozzle 20 could be integral with the fluid reservoir 18, and the securing member 81 could be a separate element as shown in FIG. 11. In the embodiment shown in FIG. 11, the fingers 80 pass through the mesh of the pouf 14 and engage openings 82 in the flange 28 of the reservoir 18. The fingers 80 could also engage the perimeter of the flange 28.

Figure 8:
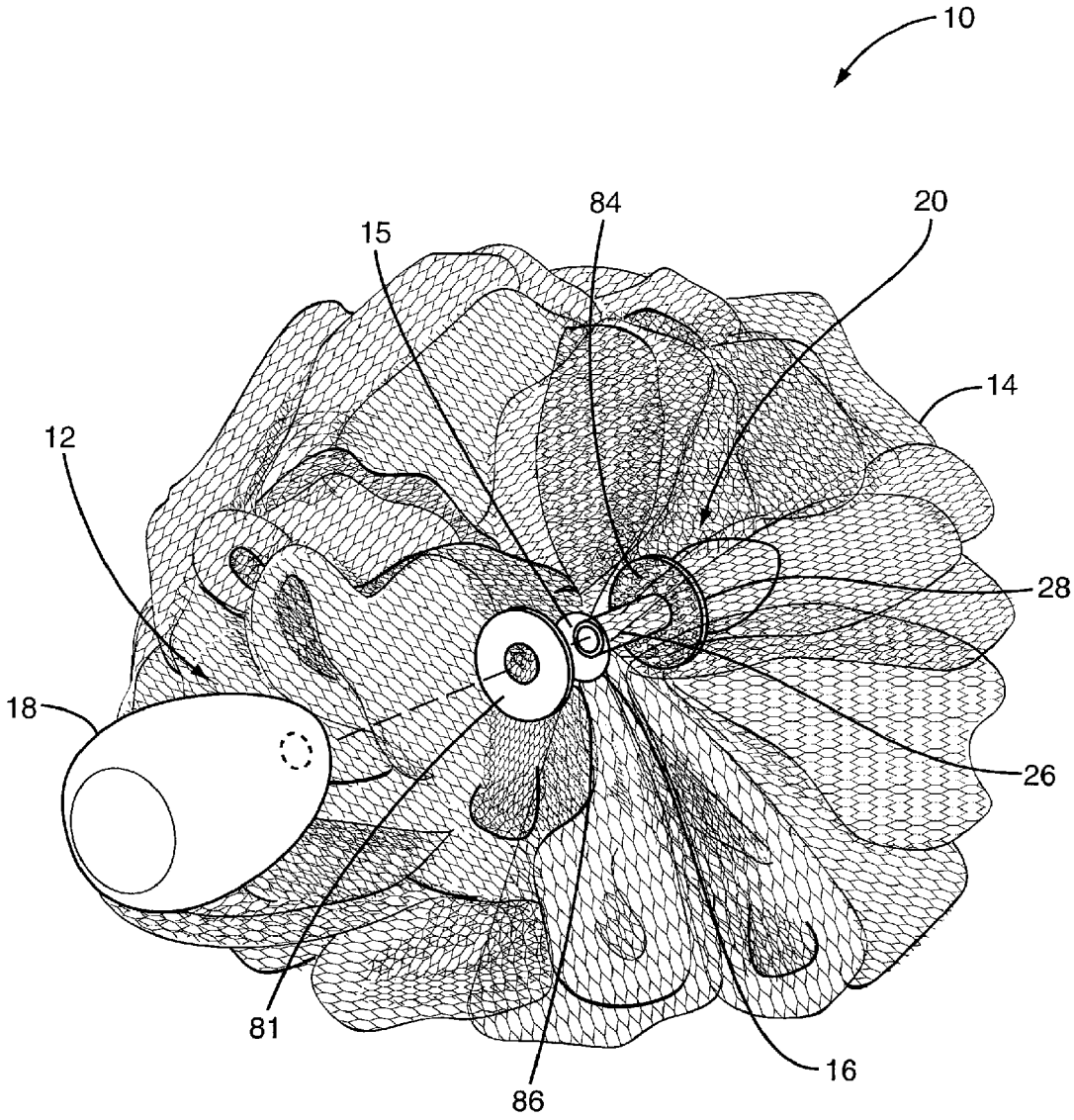
FIG. 8 is a perspective view of a fifth embodiment of the present invention.

FIG. 8 illustrates a variation of the embodiment shown in FIG. 7. In the embodiment shown in FIG. 8, the flange 28 of the nozzle 20 includes a first component 84 of a hook-and-loop fastener. The securing member 81 includes a second component 86 of the hook-and-loop fastener. When the securing member 81 is pressed against the flange 28 of the nozzle 20, the hooks on the first or second component of the hook-and-loop fastener pass through the mesh of the pouf 14 and engage the loops on the other component of the hook-and-loop fastener. The hook component may be applied to either the nozzle 20 or the securing member 81. The loop component is applied to the other member.

Figure 9:
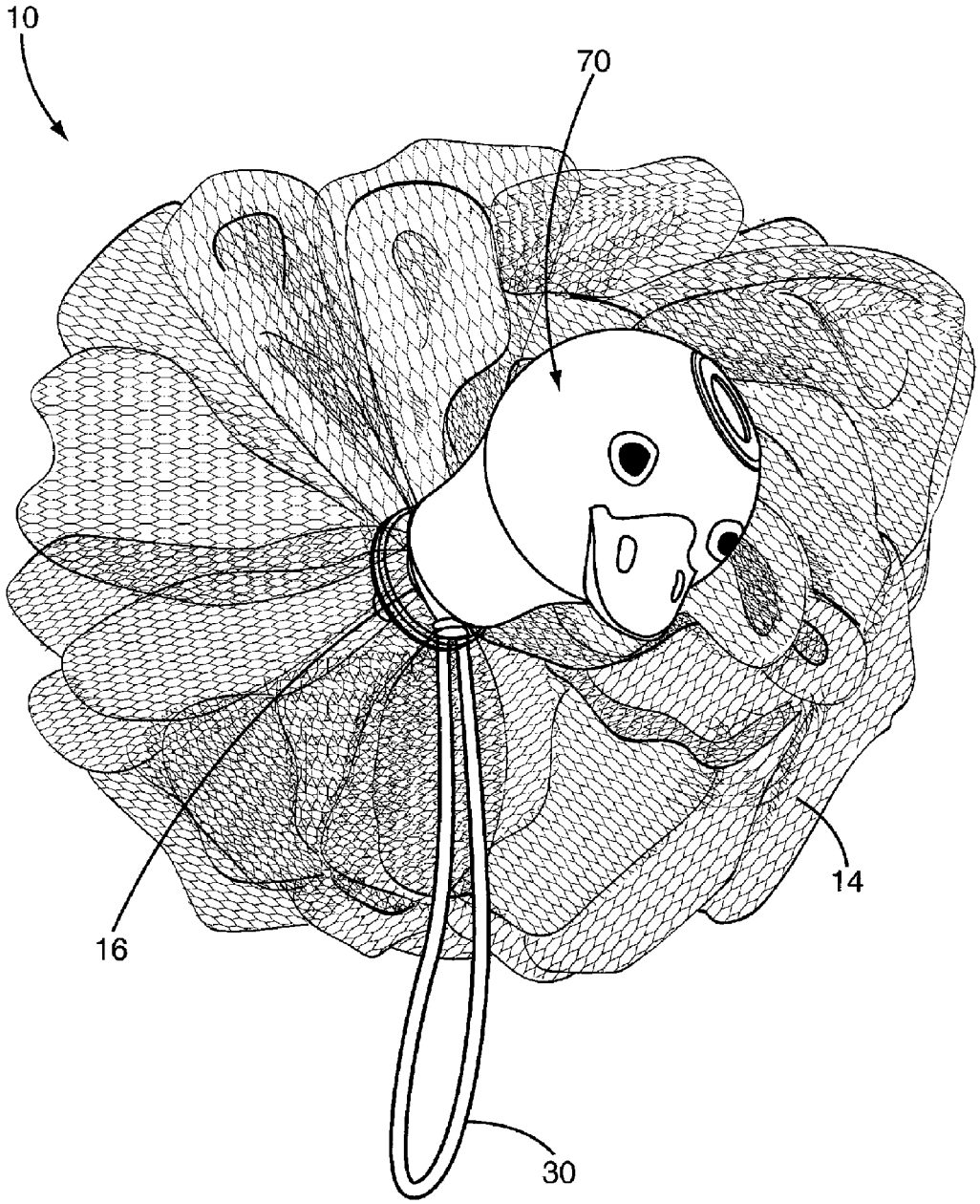
FIG. 9 is a perspective view of a sixth embodiment of the present invention.

FIG. 9 illustrates another embodiment including a pouf 14 and figurative handle 70 in the shape of an animal or cartoon character. The handle 70 may optionally function as a fluid dispenser. The pouf 14 may be secured to the figurative handle 70 by a cinch 16 as previously described. The cinch 16, as previously described, may also bind a sheet material into a pleated ball to form the pouf 14. Thus, the cinch performs the dual functions of binding the sheet material to form a pouf 14, and to secure the pouf 14 to the figurative handle 70. In the embodiment shown in FIG. 7, the cinch 16 extends around both the pouf 14 and figurative handle 70.

Figure 10:
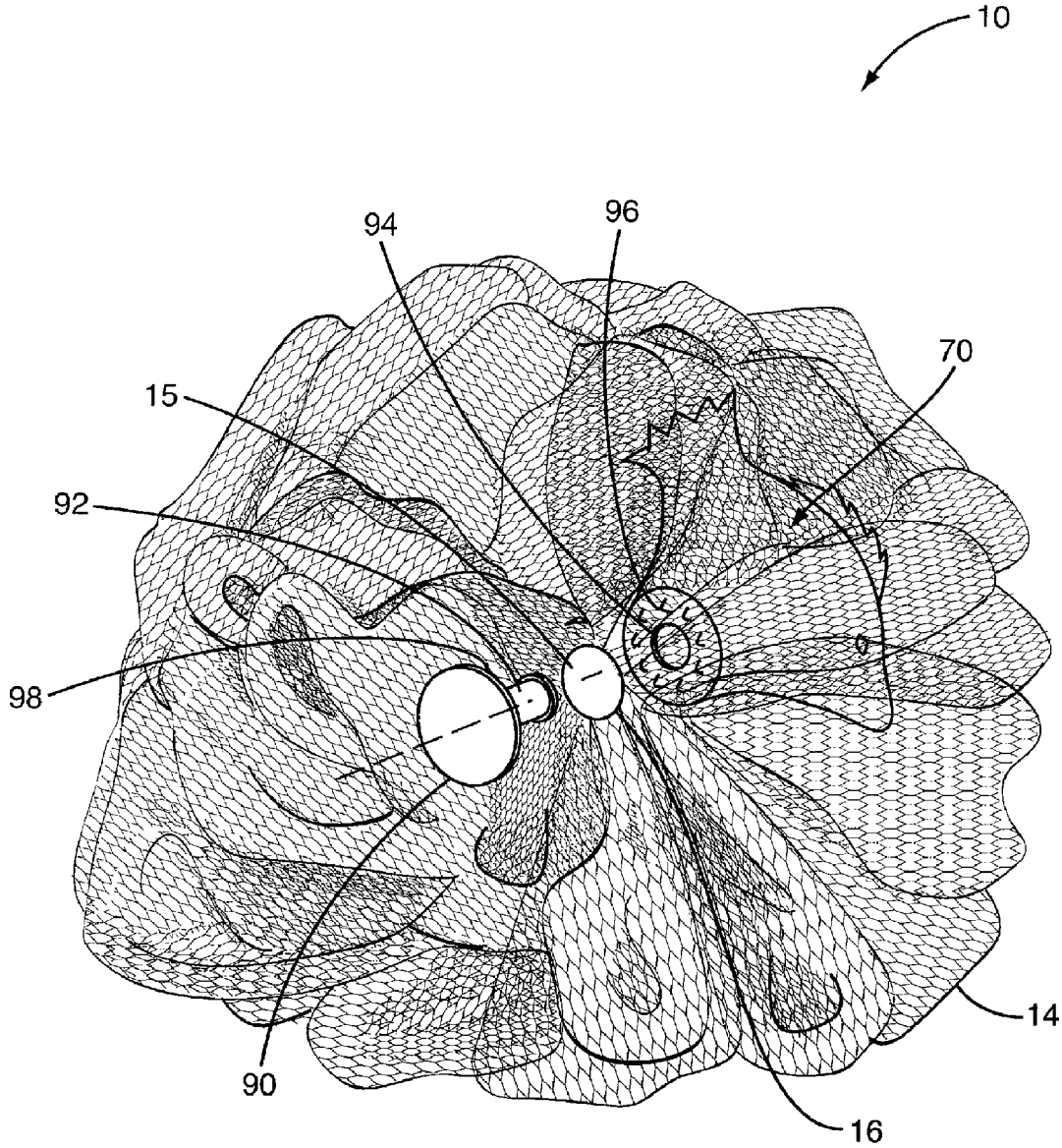
FIG. 10 is a perspective view of a seventh embodiment of the present invention.

FIG. 10 illustrates another embodiment of the invention including a pouf 14 and figurative handle 70. A securing member 90 secures the pouf 14 to the figurative handle 70. The securing member 90 comprises a button or cap with a projecting member 92 that passes through a central opening 15 in the pouf 14 and engages a corresponding opening 94 in the figurative handle 70. Those skilled in the art will appreciate that the projecting member 92 could just as well extend from the figurative handle 70 and engage an opening 94 in the securing member 90. Similar to the embodiment shown in FIG. 8, a first component 96 of a hook-and-loop fastener is disposed on the figurative handle 70 and a second component 98 of a hook-and-loop fastener is disposed on the securing member 90. In the disclosed embodiment, the first component 96 is a hook component and a second component 98 is a loop component. The components could, however, be interchanged. When the securing member 90 is pressed into the figurative handle 70, the hooks extending from the hook component 96 pass through the mesh of the pouf 14 and engage the corresponding loops on the loop component 98. The hook-and-loop fastener components are not a required element of this embodiment. As an alternative to hook-and-loop fastener components, an adhesive may be applied to the base of the figurative handle 70 and/or securing member 90. When the securing member 90 is pressed into the figurative handle 70, the adhesive flows through the mesh of the pouf 14 to help secure the pouf 14 to the figurative handle 70.

The present invention may be carried out in other specific ways than those herein set forth without departing from the scope and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A washing device comprising:

a pouf formed from a sheet-like mesh material gathered into a pleated ball;

a handle in the form of a character, said pouf including a central opening; and means for securing the pouf to the handle, said securing means comprising a securing member to receive a projecting member extending from the handle and passing through the central opening in the pouf.

2. A washing device comprising:

a pouf formed from a sheet-like mesh material gathered into a pleated ball;

a handle in the form of a character, said pouf including a central opening; and means for securing the pouf to the handle wherein one of said handle and said securing means includes a projecting member that passes through the central opening in said pouf, said securing means comprising a securing member having a hook and loop fastener component.

3. A washing device comprising:

a pouf formed from a sheet-like mesh material gathered into a pleated ball;

a handle in the form of a character, said pouf including a central opening; and means for securing the pouf to the handle wherein one of said handle and said securing means includes a projecting member that passes through the central opening in said pouf, said securing means comprising a securing member having an adhesive compound for bonding with the mesh of the pouf.

* * * * *